US008519633B2

(12) United States Patent
Zahner et al.

(10) Patent No.: US 8,519,633 B2
(45) Date of Patent: Aug. 27, 2013

(54) METHOD FOR PRODUCING A CONTROL DEVICE FOR OPERATING A RADIATION-EMITTING SEMICONDUCTOR COMPONENT

(75) Inventors: Thomas Zahner, Altenstadt (DE); Florian Dams, Regensburg (DE); Peter Holzer, Obertraubling (DE); Stefan Groetsch, Lengfeld-Bad Abbach (DE)

(73) Assignee: OSRAM Opto Semiconductor GmbH, Regensburg (DE)

( * ) Notice: Subject to any disclaimer, the term of this patent is extended or adjusted under 35 U.S.C. 154(b) by 457 days.

(21) Appl. No.: 12/528,005

(22) PCT Filed: Feb. 15, 2008

(86) PCT No.: PCT/DE2008/000290

§ 371 (c)(1), (2), (4) Date: Sep. 28, 2009

(87) PCT Pub. No.: WO2008/104152

PCT Pub. Date: Sep. 4, 2008

(65) Prior Publication Data

US 2010/0090610 A1 Apr. 15, 2010

(30) Foreign Application Priority Data

Feb. 27, 2007 (DE) ..... 10 2007 009 532

(51) Int. Cl.
*H05B 41/14* (2006.01)
*H05B 37/00* (2006.01)

(52) U.S. Cl.
USPC ..... 315/291; 315/158; 315/246; 315/302; 315/309; 347/144; 347/196; 347/247; 347/252

(58) Field of Classification Search
USPC ..... 315/158, 246, 291, 292, 302, 380; 347/247
See application file for complete search history.

(56) References Cited

U.S. PATENT DOCUMENTS

| | | | | |
|---|---|---|---|---|
| 3,705,316 | A | 12/1972 | Burrous et al. | |
| 5,907,569 | A | 5/1999 | Glance et al. | |
| 6,031,855 | A | 2/2000 | Watanabe | |
| 6,198,497 | B1 * | 3/2001 | Luque | 347/247 |
| 6,242,870 | B1 | 6/2001 | Koyanagi et al. | |
| 6,356,774 | B1 | 3/2002 | Bernstein et al. | |
| 6,807,202 | B1 | 10/2004 | Plamper et al. | |

(Continued)

FOREIGN PATENT DOCUMENTS

| | | |
|---|---|---|
| DE | 199 12 463 A1 | 9/2000 |
| DE | 102 01 053 A1 | 8/2002 |

(Continued)

*Primary Examiner* — Douglas W Owens
*Assistant Examiner* — Thai Pham
(74) *Attorney, Agent, or Firm* — Slater & Matsil, L.L.P.

(57) ABSTRACT

A pulsed electric operating current that rises during a pulse duration is generated for operating at least one radiation-emitting semiconductor component. For this purpose, in a method for producing a control device for operating the at least one radiation-emitting semiconductor component, a temporal profile of a thermal impedance representative of the at least one radiation-emitting semiconductor component is determined. A profile of the electric operating current that is to be set is determined depending on the determined temporal profile of the thermal impedance. The control device is furthermore designed such that the profile of the operating current that is to be set is set in each case during the pulse duration.

10 Claims, 6 Drawing Sheets

(56) References Cited

U.S. PATENT DOCUMENTS

| | | | | |
|---|---|---|---|---|
| 7,193,248 | B2 | 3/2007 | Weindorf et al. | |
| 7,443,413 | B2 * | 10/2008 | Jodra et al. | 347/247 |
| 7,504,781 | B2 | 3/2009 | Wendt et al. | |
| 7,528,556 | B2 | 5/2009 | Langgassner et al. | |
| 7,880,400 | B2 * | 2/2011 | Zhou et al. | 315/247 |
| 2002/0190666 | A1 | 12/2002 | Sakamoto et al. | |
| 2004/0041758 | A1 | 3/2004 | Kurusu | |
| 2006/0092099 | A1 | 5/2006 | Matsuda | |
| 2009/0079362 | A1 * | 3/2009 | Shteynberg et al. | 315/294 |

FOREIGN PATENT DOCUMENTS

| | | | |
|---|---|---|---|
| DE | 100 40 155 | A1 | 3/2003 |
| DE | 10 2004 018 912 | A1 | 11/2005 |
| DE | 10 2005 051 825 | A1 | 5/2006 |
| JP | 61- 051887 | A | 3/1986 |
| JP | 09-270555 | A | 10/1997 |
| JP | 2004-087595 | A | 3/2004 |
| JP | 2005-303091 | A | 10/2005 |
| TW | 200633574 | | 9/2006 |
| WO | WO 2006/043232 | A1 | 4/2006 |

* cited by examiner

METHOD FOR PRODUCING A CONTROL DEVICE FOR OPERATING A RADIATION-EMITTING SEMICONDUCTOR COMPONENT

This patent application is a national phase filing under section 371 of PCT/DE2008/000290, filed Feb. 15, 2008, which claims the priority of German patent application 10 2007 009 532.7, filed Feb. 27, 2007. The disclosure content of each application is hereby incorporated by reference in its entirety.

TECHNICAL FIELD

The invention relates to a control method and a control device for operating at least one radiation-emitting semiconductor component. The invention furthermore relates to a method for producing the control device.

BACKGROUND

Radiation-emitting semiconductor components are used, for example, as light-emitting diodes, or for short: LED, for signaling purposes and increasingly also for lighting purposes. By way of example, different-colored LEDs, in particular, LEDs emitting red, green or blue light, are used for projecting color images. For this purpose, the different-colored LEDs alternately illuminate in rapid succession an arrangement of micromirrors, which are driven in such a way as to produce the desired color impression of a respective pixel depending on the respective time duration for which the light from the respective LED falls onto the respective pixel. For a viewer, the alternate projection in rapid succession of, for example, a red, a green and a blue partial image gives rise to a colored image impression, which can also be comprised of mixed colors, for example, white. For this purpose, the LEDs have to be operated in each case in a pulsed operation mode, that is to say, have to be switched on and off again in rapid succession.

SUMMARY

In one aspect, the invention provides a control method, a control device and a method for producing the control device which enables pulsed operation of a radiation-emitting semiconductor component with a homogeneous radiation flux.

In accordance with a first aspect, the invention is distinguished by a control method and a corresponding control device. A pulsed electric operating current that rises during a pulse duration is generated for operating at least one radiation-emitting semiconductor component. In this case, the pulse duration, in particular, does not comprise a rising or falling edge of the electric operating current that arises as a result of the electric operating current being switched on or switched off.

The invention is based on the insight that the at least one radiation-emitting semiconductor component heats up during the pulse duration and, as a result, the radiation flux decreases during the pulse duration if the electric operating current remains substantially constant during the pulse duration. The decrease in the radiation flux can be counteracted by the operating current that rises during the pulse duration. Reliable pulsed operation of the at least one radiation-emitting semiconductor component is possible as a result.

In one advantageous configuration, the electric operating current is generated in such a way that a radiation flux of the at least one radiation-emitting semiconductor component changes only within a predetermined radiation flux tolerance band during the pulse duration. In particular, the electric operating current is generated in such a way that the radiation flux of the at least one radiation-emitting semiconductor component is substantially constant. This has the advantage that the at least one radiation-emitting semiconductor component is thereby particularly well suited to applications in which the at least one radiation-emitting semiconductor component is operated in pulsed operation and in which a high uniformity and lack of fluctuation of the radiation flux during the pulse duration are required.

In a further advantageous configuration, a pulsed electric switching current is generated. An electric compensation current is generated, which is superposed on the electric switching current in order to generate the electric operating current of the at least one radiation-emitting semiconductor component. The electric compensation current rises during the pulse duration. The electric operating current that rises during the pulse duration is generated very simply in this way. The advantage is that the electric switching current and the electric compensation current can be generated independently of one another. The electric switching current can be generated, for example, very simply with a rectangular waveform. This current is superposed with the rising electric compensation current.

In a further advantageous configuration, a profile of the electric operating current and respectively of the electric compensation current is generated depending on a sum formed using at least one summand of the form $A*(1-\exp(-t/tau))$ where a time constant tau and a factor A are predetermined in each case. This has the advantage that the precision of the profile of the electric operating current and respectively of the electric compensation current can be predetermined very simply by way of a number of summands. Furthermore, the profile can be generated simply and cost-effectively in this way.

In a further advantageous configuration of the control device, the latter together with the at least one radiation-emitting semiconductor component is formed as a common structural unit. In particular, the control device forms a driver circuit for the at least one radiation-emitting semiconductor component. By being formed as a common structural unit, for example, as a module, it can be formed in particularly compact fashion. Furthermore, the control device can be formed in a manner adjusted in accordance with the associated at least one radiation-emitting semiconductor component, such that the associated at least one radiation-emitting semiconductor component can be driven particularly precisely and the resulting radiation flux is particularly reliable.

In accordance with a second aspect, the invention is distinguished by a method for producing the control device for operating at least one radiation-emitting semiconductor component by means of a pulsed electric operating current that rises during a pulse duration. A temporal profile of a thermal impedance representative of the at least one radiation-emitting semiconductor component is determined. A profile of the electric operating current that is to be set is determined depending on the determined temporal profile of the thermal impedance. The control device is furthermore designed such that the profile of the operating current that is to be set is set in each case during the pulse duration. The pulse duration, in particular, does not comprise a rising or falling edge of the electric operating current that arises as a result of the electric operating current being switched on or switched off.

The temporal profile of the thermal impedance of the at least one radiation-emitting semiconductor component can be determined simply by measurement techniques and is substantially design- and material-dependent. In an advantageous manner, the temporal profile of the thermal impedance is not determined for each individual radiation-emitting semiconductor component, but rather is determined representatively of all or a subset of the radiation-emitting semiconductor components of the same design and with the same material selection. As a result, the control device can be produced simply and cost-effectively in large numbers. The profile to be set of the electric operating current and respectively of the electric compensation current can be determined precisely by using the profile of the thermal impedance.

In one advantageous configuration of the second aspect, the profile of the electric operating current that is to be set is determined in such a way that a radiation flux of the at least one radiation-emitting semiconductor component changes only within a predetermined radiation flux tolerance band during the pulse duration. In particular, the profile of the electric operating current that is to be set is determined in such a way that the radiation flux of the at least one radiation-emitting semiconductor component is substantially constant. This has the advantage that the at least one radiation-emitting semiconductor component is thereby particularly well suited to applications in which the at least one radiation-emitting semiconductor component is operated in pulsed operation and in which a high uniformity and lack of fluctuation of the radiation flux during the pulse duration are required.

In a further advantageous configuration of the second aspect, the control device is designed to generate a pulsed electric switching current. Determining the profile of the operating current that is to be set comprises determining the profile to be set of an electric compensation current that rises during the pulse duration and is superposed on the electric switching current in order to generate the electric operating current. The control device is furthermore designed such that the profile of the compensation current that is to be set is set in each case during the pulse duration. This has the advantage that the electric switching current and the electric compensation current can be set independently of one another. In particular, the electric switching current can be set very simply with a rectangular waveform.

In a further advantageous configuration of the second aspect, a voltage-current characteristic curve and/or a radiation flux-current characteristic curve and/or a radiation flux-junction temperature characteristic curve is determined, which is in each case representative of the at least one radiation-emitting semiconductor component. The profile to be set of the electric operating current and respectively of the electric compensation current is determined depending on the voltage-current characteristic curve and/or radiation flux-current characteristic curve and/or radiation flux junction temperature characteristic curve. The characteristic curves are generally known from characteristic data of the at least one radiation-emitting semiconductor component which are made available, for example, by the manufacturer or can be determined in a simple manner by measurement. The profile to be set of the electric operating current and respectively of the electric compensation current can be determined precisely by taking account of at least one of the characteristic curves.

In this context it is advantageous if the profile to be set of the electric operating current and respectively of the electric compensation current is determined depending on a sum formed using at least one summand of the form $A*(1-\exp(-t/tau))$. A time constant tau is in each case determined depending on the temporal profile of the thermal impedance. A factor A is in each case determined depending on the voltage-current characteristic curve determined and/or the radiation flux-current characteristic curve determined and/or the radiation flux junction temperature characteristic curve determined. The respective time constant tau and/or the respective factor A can be determined, for example, by approximation to a predetermined profile of the electric operating current and respectively of the electric compensation current that is predetermined by a physical model of the at least one radiation-emitting semiconductor component. For this purpose, preferably the temporal profile of the thermal impedance and/or the voltage-current characteristic curve determined and/or the radiation flux-current characteristic curve determined and/or the radiation flux junction temperature characteristic curve determined are fed to the physical model. In this way, the profile to be set of the electric operating current and respectively of the electric compensation current can be determined in a simple manner with the desired precision.

BRIEF DESCRIPTION OF THE DRAWINGS

Exemplary embodiments of the invention are explained below with reference to the schematic drawings, in which.

Elements having the same construction or function are provided with the same reference symbols throughout the figures.

The following list of reference signs can be used in conjunction with the drawings.

1 Radiation-emitting semiconductor component
2 Control device
3 Control line
4 Module
Φe Radiation flux
Φe0 Predetermined reference radiation flux
Φetol Predetermined radiation flux tolerance band
GND Reference potential
Ia Approximated compensation current
If Operating current
Ik Compensation current
Is Switching current
PD Pulse duration
S1-16 Step
t Time
Tj Junction temperature
VB Operating potential
Zth Thermal impedance

DETAILED DESCRIPTION OF ILLUSTRATIVE EMBODIMENTS

Measurements have shown that a radiation flux Φe of a radiation-emitting semiconductor component 1 in a pulsed operation mode decreases during a pulse duration PD. In this case, the pulse duration PD comprises for each pulse a time duration between a switch-on phase and a switch-off phase. During the switch-on phase and the switch-off phase, the radiation flux Φe changes on account of a switch-on operation and a switch-off operation, respectively. During the pulse duration PD, however, the radiation flux Φe is intended to be substantially constant.

Figure 1:
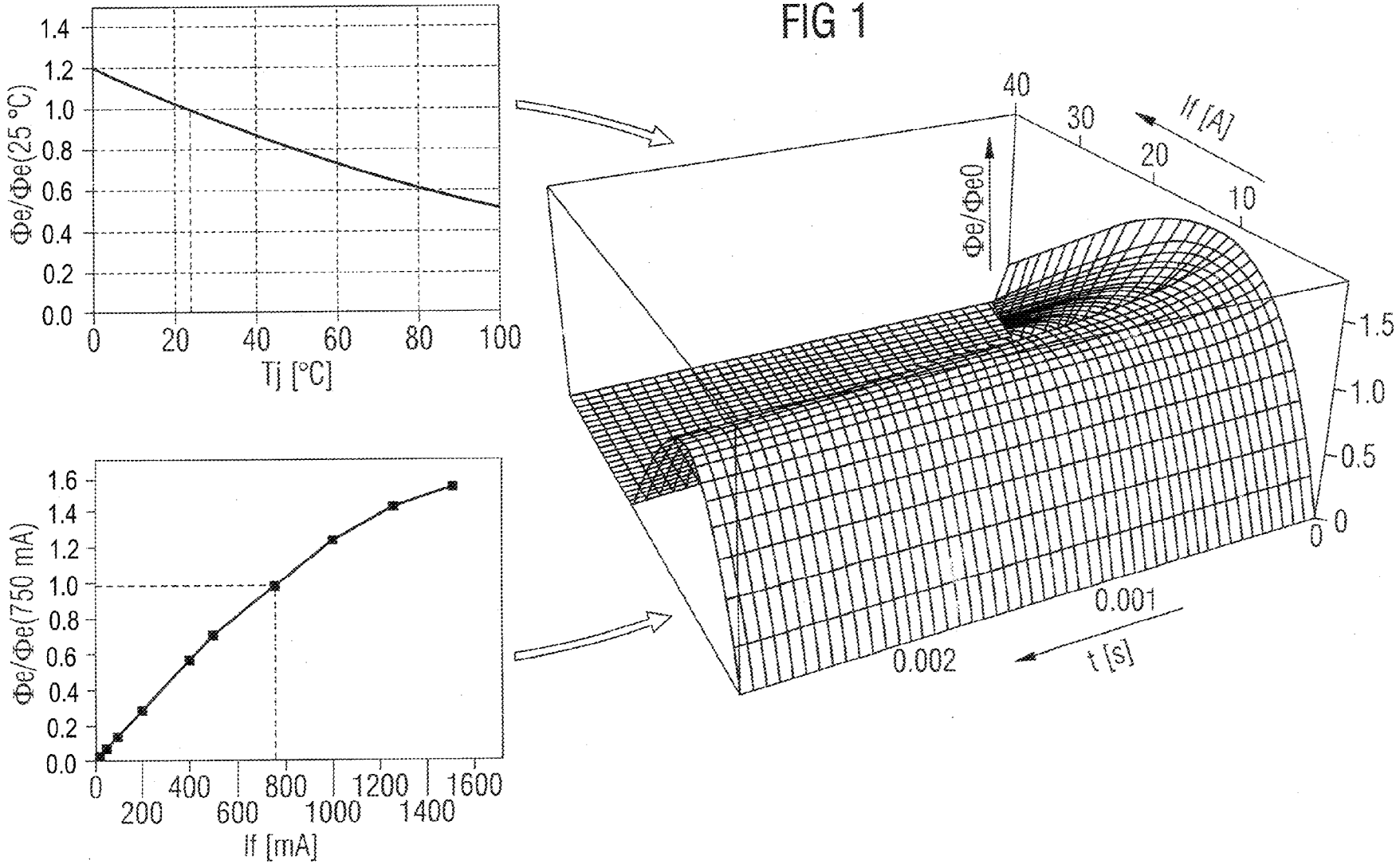
FIG. 1 shows a radiation flux junction temperature characteristic curve, a radiation flux-current characteristic curve and a radiation flux-current-time diagram.

FIG. 1 shows, at the top on the left, a radiation flux junction temperature characteristic curve, in which a first radiation flux ratio is plotted against a junction temperature Tj of a radiation-emitting semiconductor component 1. The first radiation flux ratio is formed by a ratio of a radiation flux Φe of the radiation-emitting semiconductor component 1 in relation to the radiation flux Φe which results at a predetermined junction temperature of 25° C. However, the first radiation flux ratio can also be formed differently. As the junction temperature Tj increases, the radiation flux Φe decreases. This has an adverse effect particularly during a pulsed operation mode of the radiation-emitting semiconductor component 1 if the radiation-emitting semiconductor component 1 heats up upon each pulse during the pulse duration PD thereof and cools down again after an end of the pulse. The radiation flux Φe during the respective pulse duration PD then generally decreases with increasing heating.

FIG. 1 shows, at the bottom on the left, a radiation flux-current characteristic curve of the radiation-emitting semiconductor component 1, in which a second radiation flux ratio is plotted against an electric operating current If of the radiation-emitting semiconductor component. The second radiation flux ratio is formed by a ratio of the radiation flux Φe of the radiation-emitting semiconductor component 1 in relation to the radiation flux Φe which results at a predetermined operating current of 750 mA. However, the second radiation flux ratio can also be predetermined differently. As the operating current If rises, the radiation flux Φe rises.

However, as the operating current If rises, the junction temperature Tj of the radiation-emitting semiconductor component 1 also generally rises. This holds true particularly when the pulse duration PD is long enough, that is to say a duty cycle in the pulsed operation mode is large enough, to bring about the heating of the radiation-emitting semiconductor component 1. On account of the relationship shown in the radiation flux junction temperature characteristic curve, therefore, the radiation flux Φe cannot be increased arbitrarily by increasing the operating current If and even decreases in the case of an excessively large operating current If and an excessively long pulse duration PD or an excessively large duty cycle.

Figure 2:
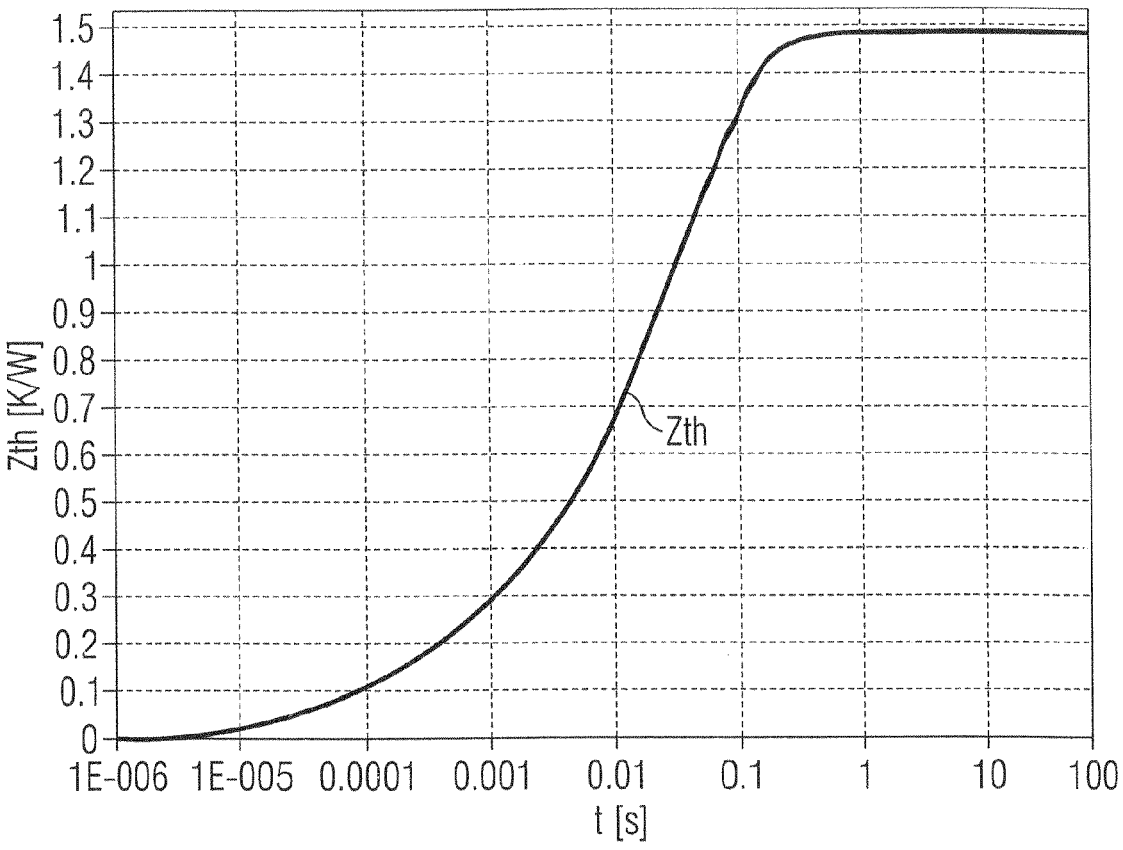
FIG. 2 shows a profile of a thermal impedance.

Depending on the radiation flux junction temperature characteristic curve, the radiation flux-current characteristic curve and depending on a temporal profile of a thermal impedance Zth of the radiation-emitting semiconductor component 1, which is illustrated in FIG. 2, it is possible to determine a radiation flux-current-time diagram that is shown on the right in FIG. 1. In the radiation flux-current-time diagram, a third radiation flux ratio is plotted against the operating current If and a time t. The third radiation flux ratio is formed by a ratio of radiation flux Φe of the radiation-emitting semiconductor component 1 in relation to a predetermined reference radiation flux Φe0. The predetermined reference radiation flux Φe0 is predetermined, for example, as the radiation flux Φe which results at the predetermined junction temperature of 25° C. and at the predetermined operating current of 750 mA. However, the predetermined reference radiation flux Φe0 can also be predetermined differently. Furthermore, the third radiation flux ratio can also be formed differently.

The radiation flux-current-time diagram can be determined, for example, by a physical model of the radiation-emitting semiconductor component 1, which, in particular, is an electro-thermo-optical model in which the relevant electrical, thermal and optical quantities are suitably combined with one another. The electrical quantities include for example the operating current If that flows through the radiation-emitting semiconductor component 1, and a voltage that is dropped across the radiation-emitting semiconductor component 1. The thermal quantities include, for example, a thermal power and also thermal resistances and thermal capacitances that are predetermined by the materials and the arrangement thereof in the radiation-emitting semiconductor component 1. The optical quantities include, for example, the radiation flux Φe. Further or other quantities can also be taken into account in the physical model. Preferably, the radiation flux junction temperature characteristic curve, the radiation flux-current characteristic curve, the profile of the thermal impedance Zth and, if appropriate, a voltage-current characteristic curve are predetermined for the physical model. In the voltage-current characteristic curve (not illustrated), the voltage dropped across the radiation-emitting semiconductor component is plotted against the operating current If.

The characteristic curves and the temporal profile of the thermal impedance Zth can be determined, for example, by measurement. The temporal profile of the thermal impedance Zth can be determined, for example, by a heating or cooling process and is dependent on the thermal resistances and the thermal capacitances of the radiation-emitting semiconductor component 1. The characteristic curves and the profile of the thermal impedance Zth are characteristic of the respective radiation-emitting semiconductor component 1.

Figure 3:
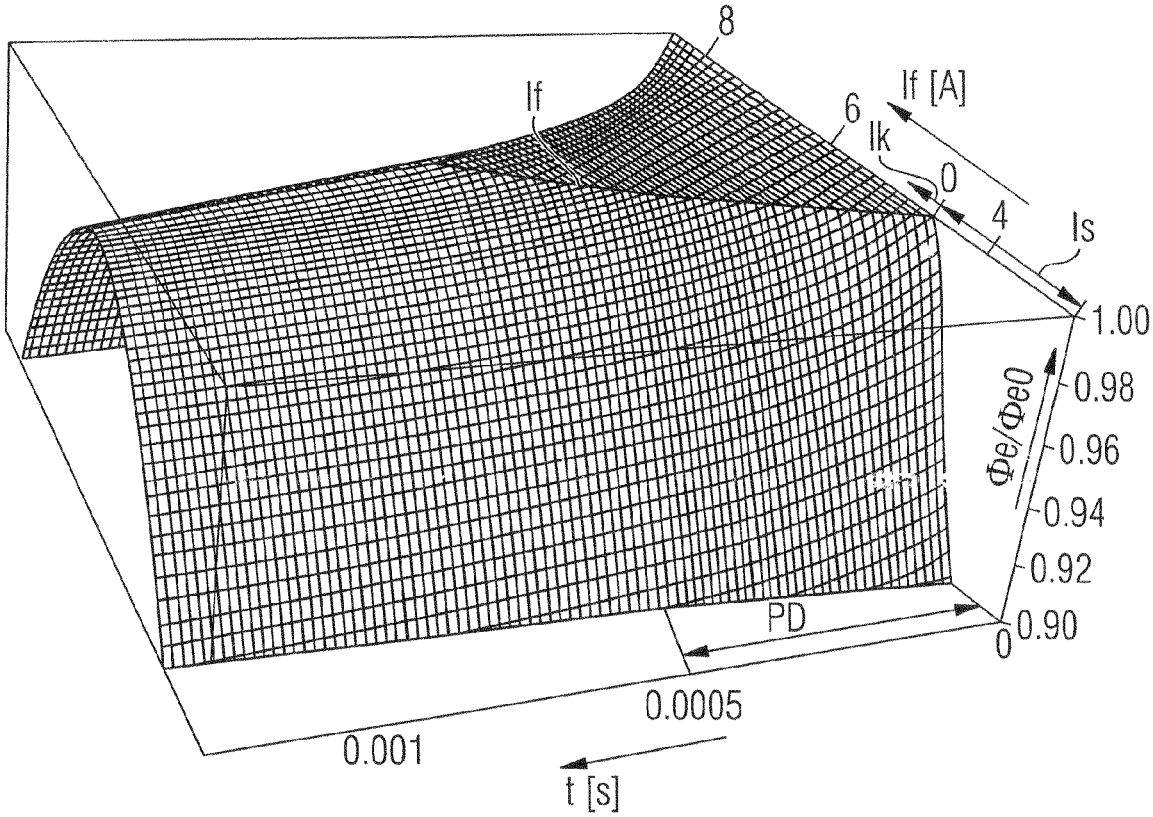
FIG. 3 shows an excerpt from the radiation flux-current-time diagram.

FIG. 3 shows an excerpt from the radiation flux-current-type diagram in accordance with FIG. 1 for the case where the third radiation flux ratio is intended to be kept constant at a value of 1. The operating current If to be set for the constant third radiation flux ratio results as a contour line in the radiation flux-current-time diagram or, to put it another way, as a line of intersection in the plane of the third radiation flux ratio with the constant value 1. Accordingly, the operating current If to be set can also be determined for another value of the third radiation flux ratio.

It can be gathered from the radiation flux-current-type diagram in FIG. 3 that the third radiation flux ratio cannot be kept at the value of 1 for a time period of arbitrary length. A further increase in the operating current If, on account of the accompanying heating of the radiation-emitting semiconductor component 1, then brings about not an increase but rather a reduction in the radiation flux Φe. The pulse duration PD must therefore be so short, or the duty cycle so small, that the third radiation flux ratio and hence the radiation flux Φe can be kept substantially constant by increasing the operating current If Provision may also be made for keeping the third radiation flux ratio constant at a value different from 1, in particular, at a lower value. Accordingly, a different line of intersection or contour line results for the profile of the operating current If that is to be set. If appropriate, in the case of a third radiation flux ratio having a value of less than 1, the pulse duration PD can be longer, or the duty cycle can be larger, without the radiation flux Φe decreasing during the pulse time duration PD.

Preferably, the profile of the operating current If to be set is determined, set and generated as a superposition, that is to say as a sum, of an electric switching current Is and an electric compensation current Ik, for compensating for the decrease in the radiation flux Φe on account of the heating during the respective pulse duration PD. The electric switching current Is is preferably provided having a rectangular waveform and therefore corresponds to rectangular pulses. The electric switching current Is is preferably substantially constant during the pulse duration PD and serves for switching on the radiation-emitting semiconductor component 1 during the pulse duration PD and for otherwise switching off the radiation-emitting semiconductor component 1. The electric compensation current Ik is provided such that it rises during the pulse duration PD in order to compensate for the decrease in the radiation flux Φe on account of the heating of the radiation-emitting semiconductor component 1. In a manner corresponding to the electric compensation current Ik, the electric operating current If also rises during the pulse duration PD.

Figure 4:
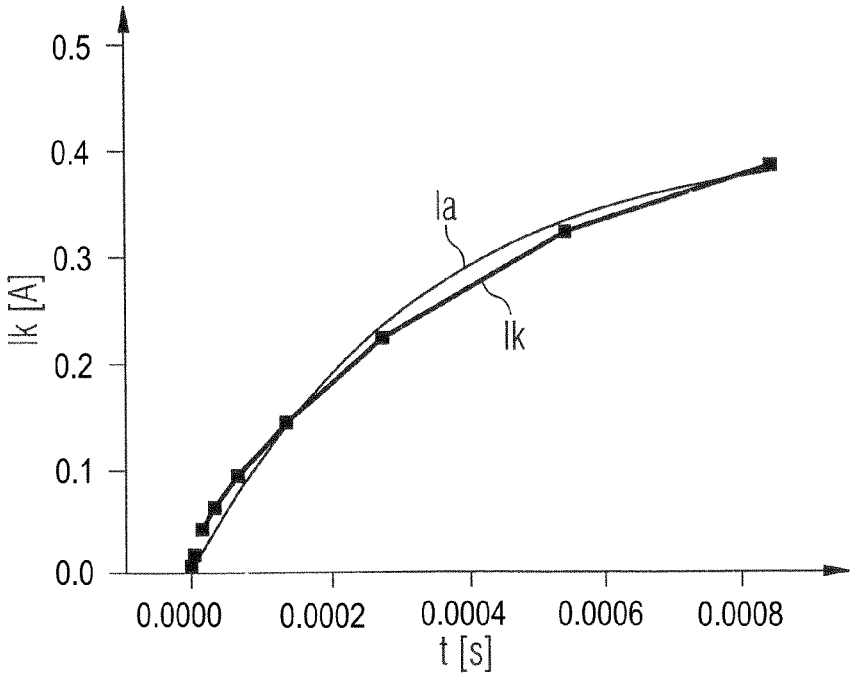
FIG. 4 shows a first current-time diagram.

FIG. 4 shows a first current-time diagram, in which the compensation current Ik such as can be determined by means of the physical model, for example, is plotted against the time t. Preferably, a profile of an approximated compensation current Ia is determined as an approximation of the profile of the compensation current Ik, which represents the profile of the compensation current Ik to be set. The profile of the approximated compensation current Ia is determined depending on a sum formed using at least one summand of the form A*(1−exp(−t/tau)). FIG. 4 shows the profile of the approximated compensation current Ia for a single summand. The precision of the approximation can be improved by taking into account further summands. In the example of FIG. 4, the function Ia=A*(1−exp(−t/tau))+I0 is fitted to the measured values for the compensation current Ik. Since only one summand of the form A*(1−exp(−t/tau)) is taken into account, the matching is not perfect. In return, the current profile Ia is given by a particularly simple function, which simplifies the generation of the compensation current. In the present case, A=−0.425 A, tau=0.00033 s and I0=0.425 A.

A time constant tau is determined in each case in a manner depending on the temporal profile of the thermal impedance Zth. If the number of summands is chosen to be equal to a number of thermal resistance-capacitance elements or thermal RC elements of the radiation-emitting semiconductor component 1 which shape the profile of the thermal impedance Zth, then the respective time constant tau corresponds to a respective time constant predetermined by a respective one of the thermal RC elements of the radiation-emitting semiconductor component 1. The thermal resistances and the thermal capacitances which form the thermal RC elements, and therefore also the associated time constants can be determined depending on the profile of the thermal impedance Zth. Furthermore, a factor A is determined in each case depending on the voltage-current characteristic curve and/or the radiation flux-current characteristic curve and/or the radiation flux junction temperature characteristic curve. On account of the simplicity of the function of the individual summands, the profile of the approximated compensation current Ia can be generated in a very simple manner, for example, by means of correspondingly formed electrical resistance-capacitance elements, which can also be designated as electrical RC elements.

Figure 5:
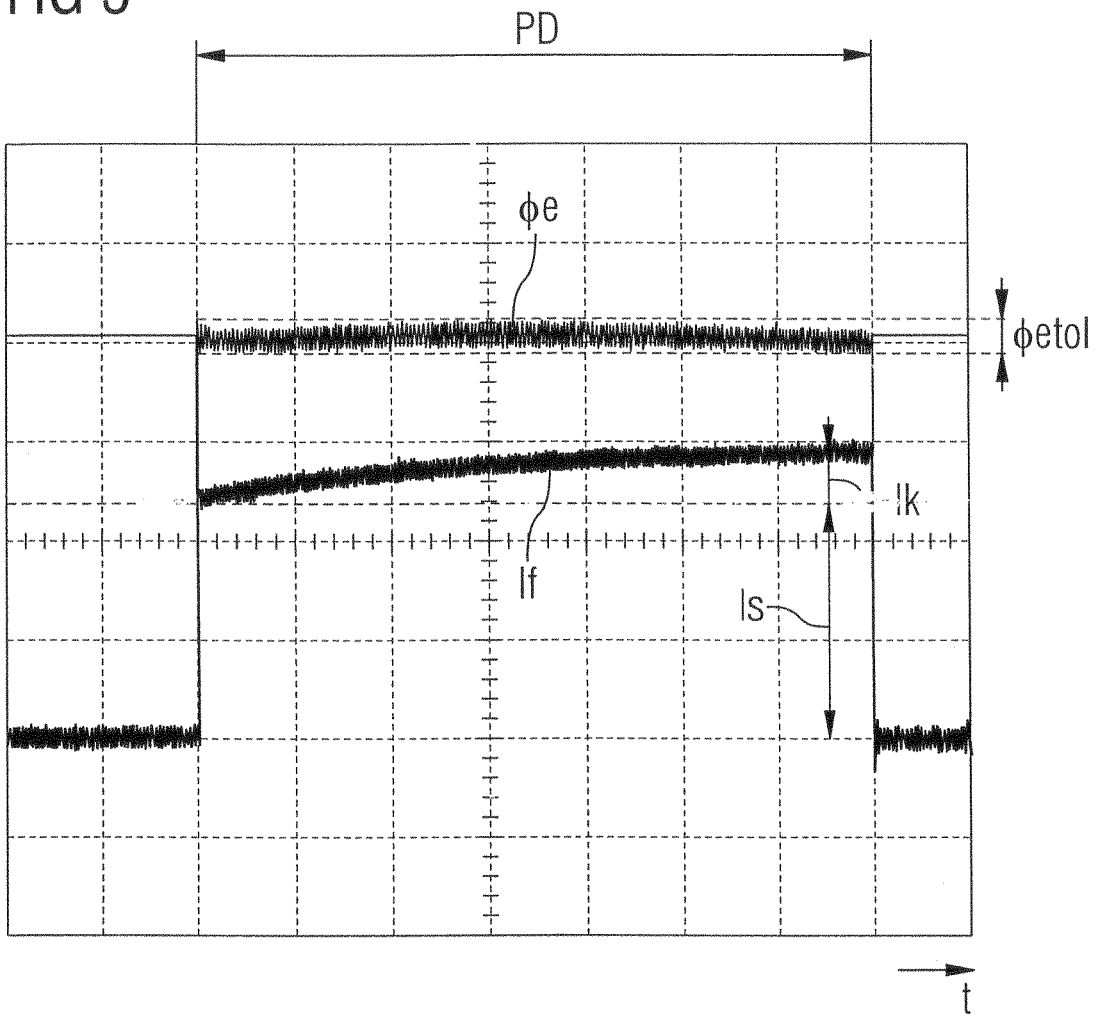
FIG. 5 shows a second current-time diagram.

FIG. 5 shows a second current-time diagram with a measured profile of the radiation flux Φe which is kept substantially constant by the rising operating current If. The measured profile of the operating current If is furthermore shown. The radiation flux Φe is intended to remain substantially constant during the pulse duration PD. To put it another way, the radiation flux Φe is intended to lie within a predetermined radiation flux tolerance band Φetol during the pulse duration PD, a maximum fluctuation range of the radiation flux Φe being predetermined by the band. By way of example, it may be predetermined that the radiation flux Φe is permitted to fluctuate only by at most 1.5% during the pulse duration PD. The width of the predetermined radiation flux tolerance band Φetol can be predetermined in accordance with the requirements. The operating current If and, if appropriate, the compensation current Ik or correspondingly the approximated compensation current Ia must be generated correspondingly precisely. However, the predetermined radiation flux tolerance band Φetol can also be predetermined differently.

Figure 6:
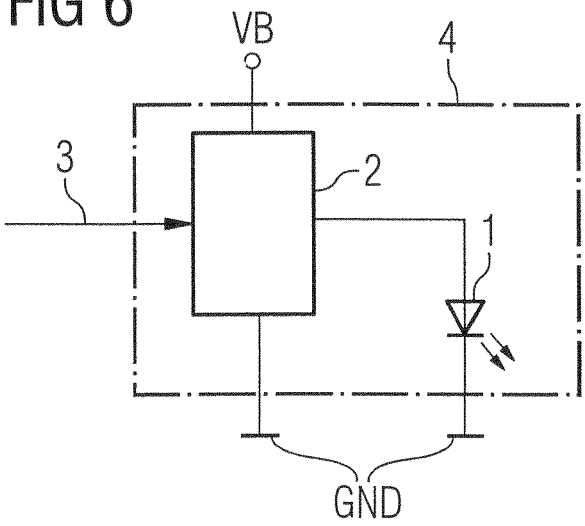
FIG. 6 shows a control device and a radiation-emitting semiconductor component.

FIG. 6 shows a control device 2 and a radiation-emitting semiconductor component 1, which is electrically coupled to an output of the control device 2. The control device is electrically coupled to an operating potential VB and a reference potential GND. On the input side, the control device 2 can be coupled to a control line 3, via which control signals, for example, can be fed to the control device 2 for initiating the respective pulse for the pulsed operation of the radiation-emitting semiconductor component 1. The control device 2 is designed to generate the pulsed electric operating current If that rises during the pulse duration PD for driving the radiation-emitting semiconductor component 1. Preferably, the control device 2 is formed as a driver circuit for the radiation-emitting semiconductor component 1. Furthermore, the control device 2 and the radiation-emitting semiconductor component 1 are preferably formed together as a common structural unit in a module 4. Provision may also be made for operating two or more radiation-emitting semiconductor components 1 by means of the control device 2 and/or arranging them in the module 4.

Figure 7:
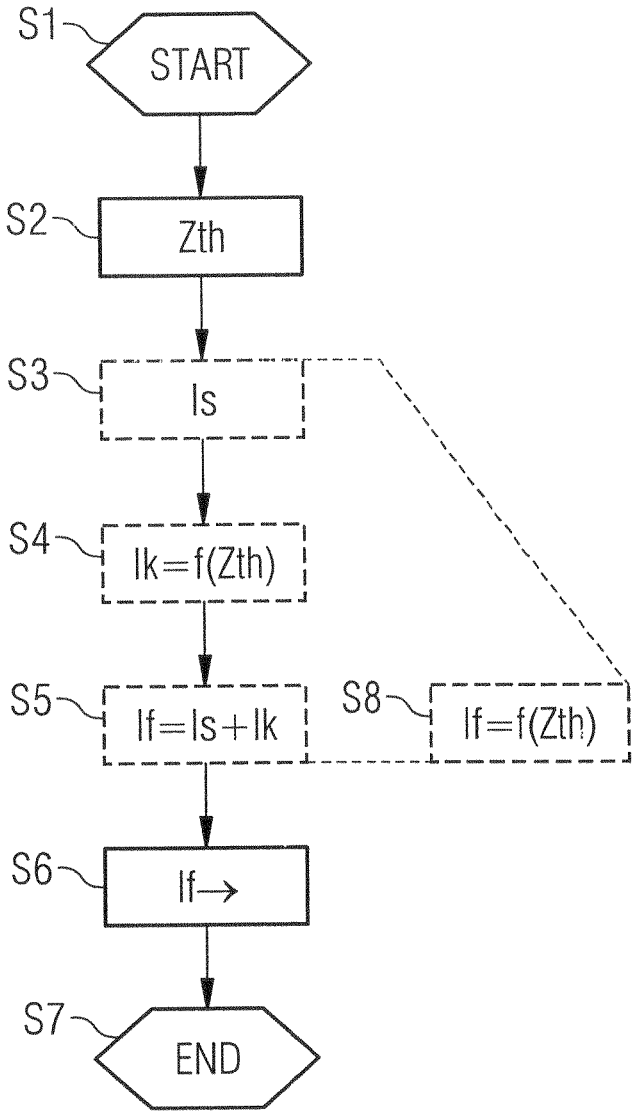
FIG. 7 shows a first flowchart.

FIG. 7 shows a first flowchart of a method for producing the control device 2. The method begins in a step S1. In a step S2, the temporal profile of the thermal impedance Zth is determined. This is preferably effected in a manner representative of a group of radiation-emitting semiconductor components 1 of identical type. The homogeneity concerns, in particular, the design and the material selection. The temporal profiles of the thermal impedance Zth deviate from one another between different radiation-emitting semiconductor components 1 within the group only to an extent that can be afforded tolerance. Therefore, if applicable the temporal profile of the thermal impedance Zth does not have to be determined for each individual radiation-emitting semiconductor component 1. Step S2 if applicable also involves determining the radiation flux junction temperature characteristic curve and/or the radiation flux-current characteristic curve and/or the voltage-current characteristic curve, preferably in a manner representative of the group of radiation-emitting semiconductor components 1.

A step S3 can be provided, in which the control device 2 is designed such that the pulsed, preferably rectangular-waveform, electric switching current Is can be generated. A step S4 can be provided, in which the profile to be set of the electric compensation current Ik that rises during the pulse duration PD is determined, if appropriate in the form of the approximated compensation current Ia. The determination is effected depending on the detected profile of the thermal impedance Zth. The determination is preferably effected by means of the physical model of the radiation-emitting semiconductor component 1, for which the detected profile of the thermal impedance Zth is predetermined. This is done, for example, by determining the profile of the desired contour line in the radiation flux-current-time diagram and, if appropriate, carrying out the approximation of the approximated compensation current Ia. Parameters which can be used for setting the compensation current Ik are determined, for example, by means of the approximation. However, the profile of the compensation current Ik that is to be set can also be determined differently.

Furthermore, a step S5 can be provided, in which the operating current If to be set is determined as a superposition or sum of the switching current Is and the compensation current Ik. In a step S6, the control device 2 is designed such that the operating current If to be set can be generated during operation. This can be done, for example, by formation of an electrical circuit arrangement and suitable dimensioning of electrical RC elements. However, it is likewise possible for the parameters or values which represent the profile to be set of the compensation current Ik and respectively of the operating current If to be stored digitally in a memory and to be used during the pulse duration PD for setting the compensation current Ik and respectively the operating current If, for example, by the conversion of a sequence of stored values by means of a digital-to-analog converter. A further possibility consists, for example, in providing a function generator that is designed to provide, on the output side, a signal profile corresponding to the profile of the operating current If to be set or of the compensation current Ik to be set. However, the control device 2 can also be designed differently in step S6.

The method ends in a step S7. Provision may also be made for determining the operating current If to be set in a manner dependent on the determined profile of the thermal impedance Zth in a step S8, without having to determine the switching current Is and the compensation current Ik for this purpose. Therefore, the step S8 can, if applicable, replace steps S3 to S5.

Figure 8:
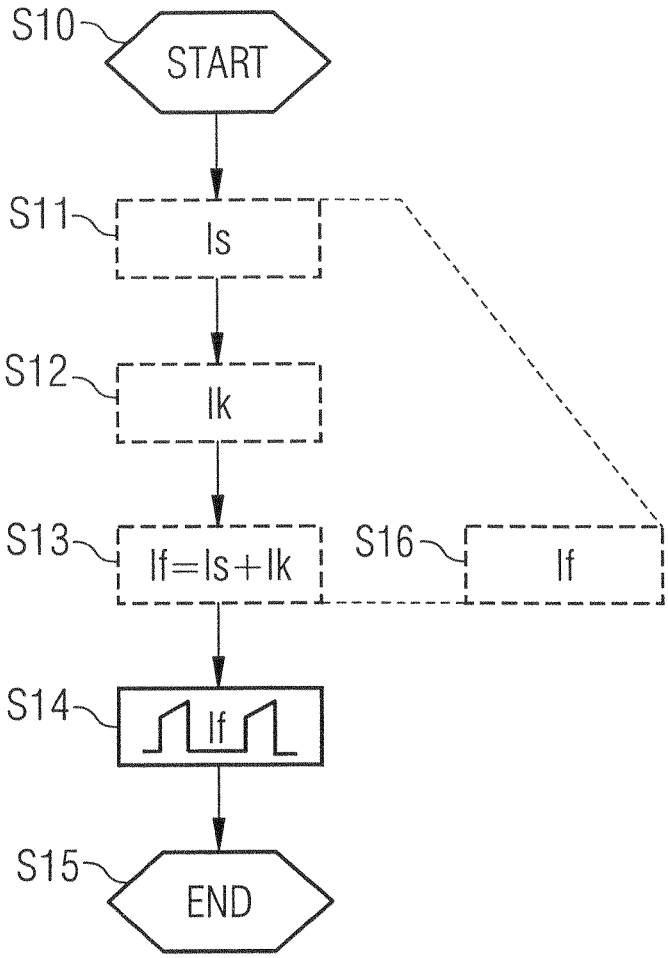
FIG. 8 shows a second flowchart.

FIG. 8 shows a second flowchart of a control method for operating the at least one radiation-emitting semiconductor element 1 by means of the pulsed electric operating current If that rises during the pulse duration PD. The control method is preferably performed by the control device 2. The control method can be implemented, for example, in the form of the electrical circuit arrangement in the control device 2. For this purpose, the electrical circuit arrangement comprises the electrical RC elements, for example. However, the control method can also be implemented as a program and be stored in a memory which the control device 2 comprises or which is electrically coupled to the control device 2. The control device 2 then comprises a computing unit, for example, which executes the program. By way of example, the computing unit, depending on the program, controls the digital-to-analog converter or some other component of the control unit which is designed to set the profile to be set of the compensation current Ik and respectively of the operating current If.

The control method begins in a step S10. In a step S11, the pulsed, preferably rectangular-waveform, electric switching current Is is generated. In a step S12, the compensation current Ik to be set is set, for example, in the form of the approximated compensation current Ia, and correspondingly generated. In a step S13, the operating current If is generated as a superposition or sum of the switching current Is and the compensation current Ik and, in a step S14, is output to the at least one radiation-emitting semiconductor component 1. The control method ends in a step S15. Provision may also be made for generating the rising operating current If in a step S16, without having to generate the switching current Is and the compensation current Ik for this purpose. Step S16 can therefore, if applicable, replace steps S11 to S13.

The invention is not restricted by the description on the basis of the exemplary embodiments. Rather, the invention encompasses any new feature and also any combination of features, which in particular comprises any combination of features in the patent claims, even if this feature or this combination itself is not explicitly specified in the patent claims or exemplary embodiments.

The invention claimed is:

1. A control method comprising:

determining a temporal profile of a thermal impedance representative of a radiation-emitting semiconductor component;

determining a profile of a pulsed electric operating current that is to be set by using a physical model of the radiation emitting semiconductor component, the determined temporal profile of the thermal impedance being fed to the physical model;

producing a control device such that the profile of the pulsed electric operating current that is predetermined using the physical model set in each case during a pulse duration, wherein the pulsed electric operating current rises during a pulse duration;

using the control device to generate the pulsed electric operating current; and operating at least one radiation-emitting semiconductor component with the pulsed electric operating current.

2. The control method according to claim 1, wherein the pulsed electric operating current is generated in such a way that a radiation flux of the at least one radiation-emitting semiconductor component changes only within a predetermined radiation flux tolerance band during the pulse duration.

3. The control method according to claim 1, wherein generating the pulsed electric operating current comprises:

generating a pulsed electric switching current; and generating an electric compensation current that rises during the pulse duration and that is superposed on the pulsed electric switching current in order to generate the pulsed electric operating current of the at least one radiation-emitting semiconductor component.

4. The control method according to claim 3, wherein a profile of the pulsed electric operating current and respectively of the electric compensation current is generated depending on a sum formed using at least one summand of the form $$A*(1-\exp(-t/\text{tau}))$$

where a time constant tau and a factor A are predetermined in each case.

5. A method for producing a control device for operating at least one radiation-emitting semiconductor component by means of a pulsed electric operating current that rises during a pulse duration, the method comprising:

determining a temporal profile of a thermal impedance representative of the at least one radiation-emitting semiconductor component, determining a profile of the pulsed electric operating current that is to be set by using a physical model of the radiation-emitting semiconductor component, the determined temporal profile of the thermal impedance being fed to the physical model, and producing the control device such that the profile of the pulsed electric operating current that is predetermined using the physical model in each case during the pulse duration.

6. The method according to claim 5, wherein the profile of the electric operating current that is to be set is determined in such a way that a radiation flux of the at least one radiation-emitting semiconductor component changes only within a predetermined radiation flux tolerance band during the pulse duration.

7. The method according to claim 5, wherein:

the control device generates a pulsed electric switching current, determining the profile of the electric operating current that is to be set comprises determining a profile to be set of an electric compensation current that rises during the pulse duration and is superposed on the electric switching current in order to generate the electric operating current, and the profile of the electric compensation current that is to be set is set in each case during the pulse duration.

8. The method according to claim 7, further comprising determining at least one curve, the at least one curve comprising a voltage-current characteristic curve and/or a radiation flux-current characteristic curve and/or a radiation flux-junction temperature characteristic curve is determined, the at least one curve representative of the at least one radiation-emitting semiconductor component, wherein the profile to be set of the electric operating current and respectively of the electric compensation current is determined depending on the at least one curve.

9. The method according to claim 8, wherein the profile to be set of the electric operating current and respectively of the electric compensation current is determined depending on a sum formed using at least one summand of a form $$A*(1-\exp(-t/\mathrm{tau}))$$

where a time constant tau depends on the temporal profile of the thermal impedance, and a factor A depends on the at least one curve.

10. The method according to claim 1, wherein the at least one radiation-emitting semiconductor component and a controller of the control device are disposed within a common structural unit.

* * * * *

UNITED STATES PATENT AND TRADEMARK OFFICE

CERTIFICATE OF CORRECTION

PATENT NO. : 8,519,633 B2
APPLICATION NO. : 12/528005
DATED : August 27, 2013
INVENTOR(S) : Thomas Zahner It is certified that error appears in the above-identified patent and that said Letters Patent is hereby corrected as shown below:

In the Claims:

In Col. 10, line 8, claim 1, delete “model set” and insert -- model is set --.
In Col. 10, line 51, claim 5, delete “model in” and insert -- model is set in --.

Signed and Sealed this
Third Day of December, 2013

Margaret A. Focarino

Margaret A. Focarino
*Commissioner for Patents of the United States Patent and Trademark Office*

UNITED STATES PATENT AND TRADEMARK OFFICE

CERTIFICATE OF CORRECTION

PATENT NO. : 8,519,633 B2
APPLICATION NO. : 12/528005
DATED : August 27, 2013
INVENTOR(S) : Zahner et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 611 days.

Signed and Sealed this
Fifteenth Day of September, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,519,633 B2
APPLICATION NO. : 12/528005
DATED : August 27, 2013
INVENTOR(S) : Thomas Zahner et al.

It is certified that error appears in the above-identified patent and that said Letters Patent is hereby corrected as shown below:

On the Title Page, item (73) Assignee, line 1, delete "OSRAM Opto Semiconductor GmbH," and insert --OSRAM Opto Semiconductors GmbH,--.

Signed and Sealed this
Twelfth Day of July, 2016

Michelle K. Lee

Michelle K. Lee
*Director of the United States Patent and Trademark Office*